US007690076B2

(12) United States Patent
Tannous

(10) Patent No.: US 7,690,076 B2
(45) Date of Patent: Apr. 6, 2010

(54) WATER PIPE STARTER AND CLEANING DEVICE

(76) Inventor: Bishara Tannous, 7763 Colony Lake Dr., Boynton Beach, FL (US) 33436-1302

( * ) Notice: Subject to any disclaimer, the term of this patent is extended or adjusted under 35 U.S.C. 154(b) by 744 days.

(21) Appl. No.: 11/430,730

(22) Filed: May 9, 2006

(65) Prior Publication Data

US 2007/0261194 A1 Nov. 15, 2007

(51) Int. Cl.
*A47L 5/00* (2006.01)
*A47L 9/00* (2006.01)
*A24F 3/02* (2006.01)

(52) U.S. Cl. ..... 15/319; 15/330; 131/243; 131/244

(58) Field of Classification Search ..... 15/330, 15/319; 131/243, 244
See application file for complete search history.

(56) References Cited

U.S. PATENT DOCUMENTS 1,513,147 A 10/1924 Zahariadis
1,722,595 A * 7/1929 Rose ..... 417/315
3,363,633 A 1/1968 Weber
3,889,690 A 6/1975 Guamieri
4,164,230 A 8/1979 Pearlman
4,193,411 A 3/1980 Faris
4,325,163 A * 4/1982 Mattson et al. ..... 15/330
4,370,690 A * 1/1983 Baker ..... 361/23
4,648,410 A 3/1987 Seroussi
4,734,017 A 3/1988 Levin
4,789,310 A * 12/1988 Hung ..... 417/234
4,810,173 A 3/1989 Thomson
6,284,056 B1 9/2001 Gonzalez
6,485,276 B2 * 11/2002 Yang ..... 417/423.14
2003/0233730 A1 * 12/2003 Sanders et al. ..... 15/405
2005/0279371 A1 12/2005 Billard

OTHER PUBLICATIONS

Copending U.S. Appl. No. 11/786,286, filed Apr. 11, 2007, Inventor Bishara Tannous.*

* cited by examiner

*Primary Examiner*—Bryan R Muller
(74) *Attorney, Agent, or Firm*—Steptoe & Johnson LLP

(57) ABSTRACT

A hookah accessory comprising a motor driven vacuum secured in a housing, vacuum port, filter between the vacuum port and vacuum used to apply a suction force used to ignite and start a hookah, blower port in pneumatic communication with the output/return port of the vacuum to provide a blow force used to clean hoses, switches in the vacuum and air pressure ports to automatically turn on the accessory when inserting a hose and fixed resistors in series with the switches for setting the vacuum at two constant speeds for a set suction force and set air pressure force. Alternatively, the accessory may have a variable resistor (rheostat) to adjust the speed of the motor, which adjusts the suction and blowing forces. The filter is in line with the vacuum port and vacuum to capture debris before it reaches the vacuum or vacuum motor. The vacuum and blower ports securely receive and hold different sized hoses and, or hose tips in a manner that creates a substantial airtight seal.

9 Claims, 7 Drawing Sheets

WATER PIPE STARTER AND CLEANING DEVICE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a water pipe accessory, and more particularly, to a tool for starting and cleaning a water pipe, such as a hookah or shisha pipe.

2. Description of the Background Art

Hookah water pipes, also known as shisha water pipes because of the tobacco typically used, and restaurants providing hookahs are well known worldwide. With reference to FIG. 1, a hookah 1 is a water pipe having a tobacco reservoir/bowl 3 in fluid/pneumatic communication with a tobacco smoke feed tube 4 that depends into a smoke chamber 5, which is partially filled with water, and one or more hoses 2 releasably attached to the water pipe 1 in fluid/pneumatic communication with the smoke chamber 5 for drawing air/oxygen through the tobacco and tobacco smoke through the hoses. Starting the hookah 1 so it ignites and remains ignited can be very difficult and time consuming. The difficulty arises because shisha comprises flavored tobaccos that are flavored with moist additives, such as molasses, making it difficult to ignite the tobacco and properly start the hookah. Some of the difficulty further arises from residue build-up in the hoses, which also causes odors. Accordingly, restaurants providing hookahs typically ignite the tobacco for the patron. Unfortunately, they confront the same obstacles, which adversely affects customer service and hence the success of the restaurant. Conventional hookahs also present health problems associated with inhaling particulate matter/debris and restaurant employees placing their mouth on the hose to ignite it. If there existed a water pipe accessory that could start and ignite the hookah 1 as well as clean its hoses 2 it would eliminate the problems associated with starting and cleaning a hookahh and save servers valuable time while making the patrons visit to the hookahh restaurant more enjoyable. However, there are no known devices that can provide the dual functions of starting a hookahh or other water pipe and cleaning hoses. If such a device existed it would be well received.

Although various pipes and smoking accessories are shown in the prior art, they fail to disclose a device or system that adequately addresses or resolves the above-noted gaps in the prior art. The background art known fails to disclose a hookahh or water pipe accessory that can start the pipe and clean its hoses to facilitate an easier draw, increase sanitary conditions and reduce or eliminate odors. For instance, U.S. Pat. No. 1,531,147, issued to Zahariadis, discloses a water pipe. U.S. Pat. No. 3,363,633, issued to Weber, discloses a battery-operated blower for keeping a non-water pipe lit. U.S. Pat. No. 3,889,690, issued to Guarnieri, discloses a water pipe having a flame igniter or electrical resistance element. U.S. Pat. No. 4,164,230, issued to Pearlman, discloses an automatic non-water smoking pipe including a fan. U.S. Pat. No. 4,190,034, issued to Wonisch, discloses a hand-held apparatus for starting and fanning a fire, such as in a fire place, by providing a source of fuel and air. U.S. Pat. No. 4,193,411, issued to Faris, discloses a power-operated non-water pipe comprising a removable cup for holding tobacco, fan and air chamber for drawing air from the bowl with the fan. U.S. Pat. No. 4,648,410, issued to Seroussi, discloses a nargile water pipe for smoking cured tobaccos. U.S. Pat. No. 4,734,017, issued to Levin, discloses a hand-held air blower with a rechargeable power supply that may be used for supplying air to a fire in a grill or fireplace. U.S. Pat. No. 4,810,173, issued to Thomson, discloses a portable air blower with an elongated hollow extension sleeve to guide forced air directly onto fire. U.S. Pat. No. 5,819,756, issued to Mielordt, discloses a device for smoking tobacco or other products. U.S. Pat. No. 6,284,056, issued to Billard, discloses a composition useful for removal of organic deposits from a ceramic, glass, plastic or metal substrate.

Based on the foregoing, the prior art discloses various pipes but fails to disclose an accessory that can be used any hookah or other comparable water pipe to start the tobacco in the water pipe and clean the pipe's hoses. Accordingly, there exists a need for such an accessory. The instant invention addresses this unfulfilled need in the prior art by providing a water pipe starter and cleaning accessory as contemplated by the instant invention disclosed herein.

BRIEF SUMMARY OF THE INVENTION

In light of the foregoing, it is an object of the present invention to provide a hookah accessory that accelerates the ignition of tobacco and starting a hookah.

It is also an object of the instant invention to provide a hookah accessory that can clean hookah hoses to remove particulates in the hose and clear resonating odors.

It is another object of the instant invention to provide a hookah accessory that can be used to clean and dry the hookah/water-pipe body.

It is an additional object of the instant invention to provide a hookah accessory that improves health conditions by eliminating the need for restaurant employees to place their mouth on the hose when starting the hookah.

It is a further object of the instant invention to provide a hookah accessory that makes it easier to draw smoke from the hookah through the hose.

It is yet another object of the instant invention to provide a hookah accessory that extends the life of hookah hoses.

It is yet a further object of the instant invention to provide a hookah accessory is cost-effective.

It is yet an additional object of the instant invention to provide a hookah accessory that is easy and convenient to use.

In light of these and other objects, the instant invention comprises a hookah accessory that makes it easier to start hookahs, clean debris from hookah hoses to make for an easier draw, remove odors and improve health conditions, clean hookah bodies and dry hookahs and hoses. The instant invention also improves health and sanitation conditions by eliminating the need for restaurant employees to make mouth contact with the pipe hose. The hookah accessory comprises a motor driven vacuum secured in a housing, vacuum port, filter between the vacuum port and vacuum, blower port in pneumatic communication with the output/return port of the vacuum and variable resistor (rheostat) to adjust the speed of the motor, which adjusts the suction and blowing forces. The filter is in line with the vacuum port and vacuum to capture debris before it reaches the vacuum or vacuum motor. The vacuum and blower ports preferably comprise pliable rubber ends for universal use in securely receiving and holding different sized hoses and, or hose tips. Switches may be disposed in the vacuum and blower ports or hose tip, which turn on the hookah accessory when a hose is inserted and turn it off when removed. Alternatively, switches may be positioned for manual actuation. The suction or blowing forces may be preset so the accessory turns on at the appropriate level of suction or pressure. The instant invention may also include hoses adapted for use with a hookah and the hookah accessory. The preferred hose has a tapered end or tip for creating an airtight seal when inserted in a port.

To use the hookah accessory for starting a hookah, the hose is placed in the vacuum port, activating the vacuum and vacuum motor. The suction force may be increased or decreased by adjusting the rheostat setting. A low suction force is preferred for starting the hookah. While the vacuum is running, fire is applied to the tobacco to ignite it. The suction force provided by the vacuum draws air and smoke through the tobacco causing the fire to ignite it more quickly then without the suction force. Once ignited, the hose is removed from the vacuum port, which preferably de-activates the hookah accessory. The suction force may be increased or decreased by adjusting the rheostat.

To use the hookah accessory to clean a hookah and, or hose, the hose is first removed from the hookah. The hose tip is then inserted into the blower port, which preferably activates the vacuum and vacuum motor creating an air pressure source in the vacuum return port. Once the hookah accessory is energized, air is blown out through the blower port and through the hose forcing out debris and odor. The blow force may be increased or decreased by adjusting the rheostat. Once clean, the hoses may be reconnected to the hookah.

In accordance with these and other objects, which will become apparent hereinafter, the instant invention will now be described with particular reference to the accompanying drawings.

DETAILED DESCRIPTION OF THE INVENTION

Figure 1:
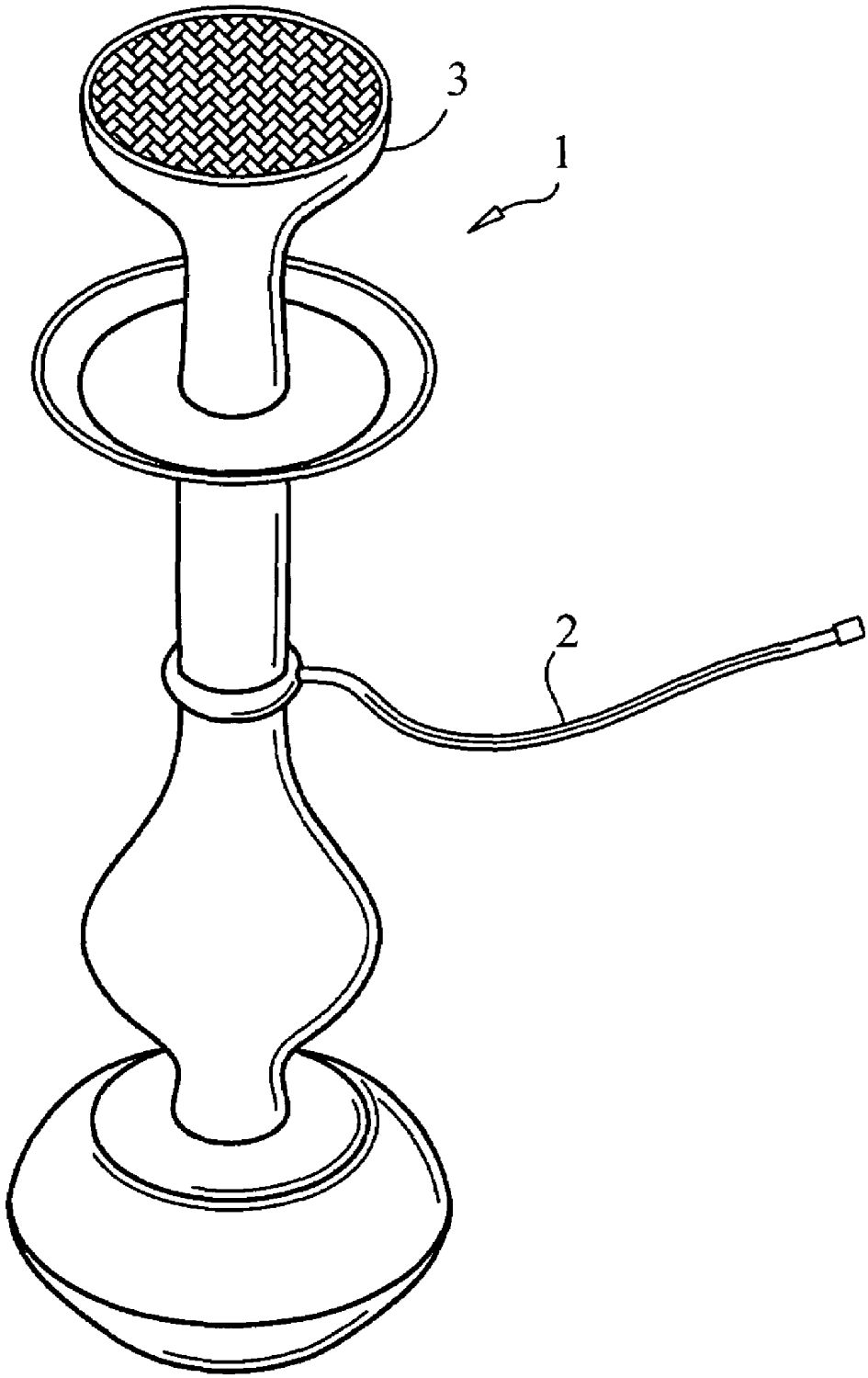
FIG. 1 is a partial perspective view of a hookah generally depicting hookahs known in the prior art that may be used with the hookah accessory of the instant invention.
Figure 2:
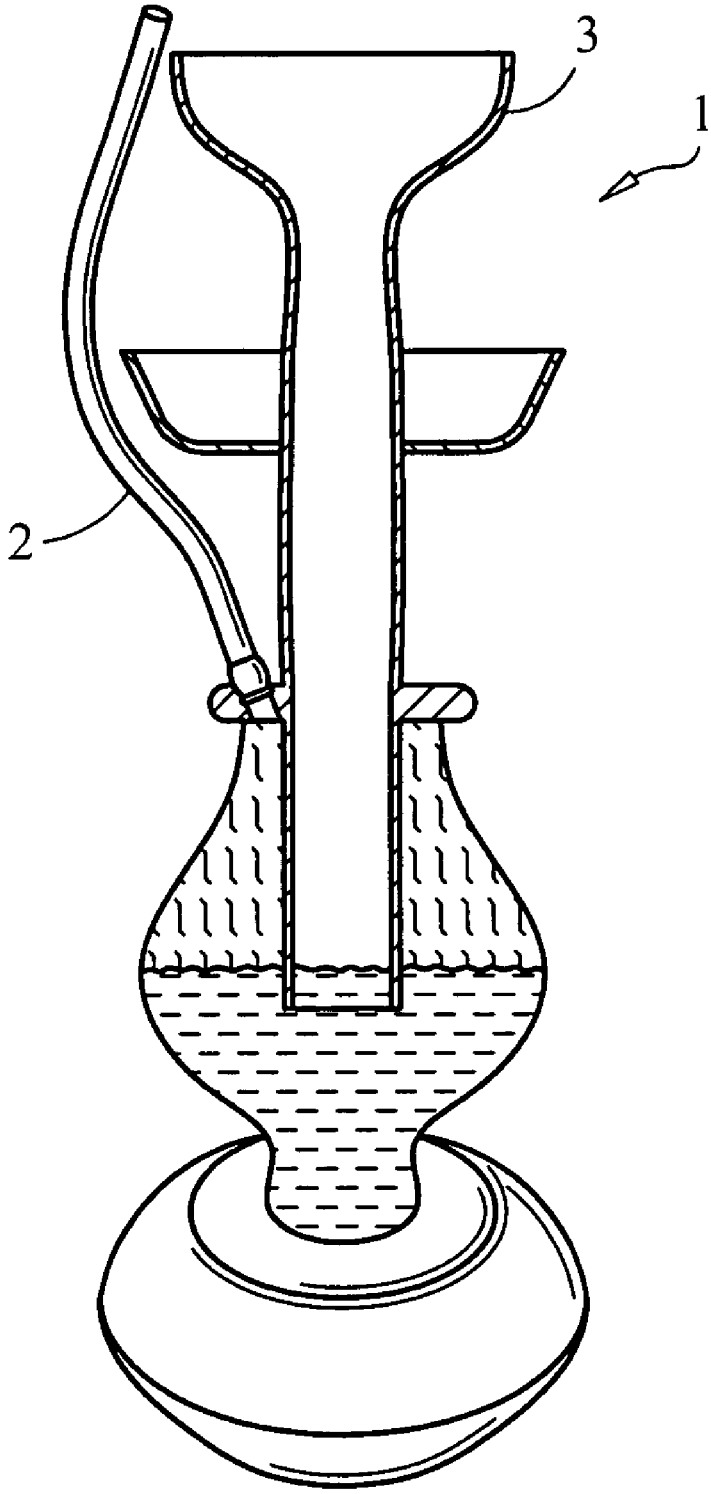
FIG. 2 is a partial cross-sectional view of the hookah shown in FIG. 1.
Figure 3:
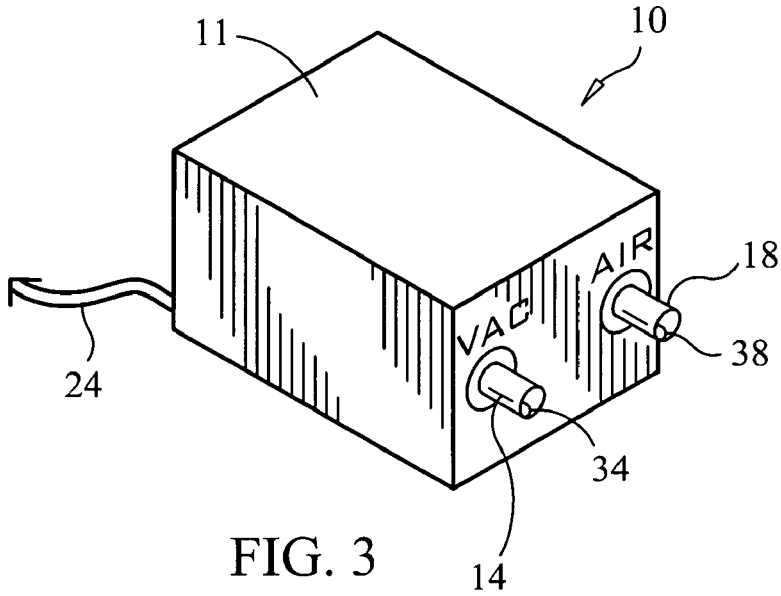
FIG. 3 is a perspective view of the preferred embodiment of the hookah accessory in accordance with the instant invention.
Figure 4:
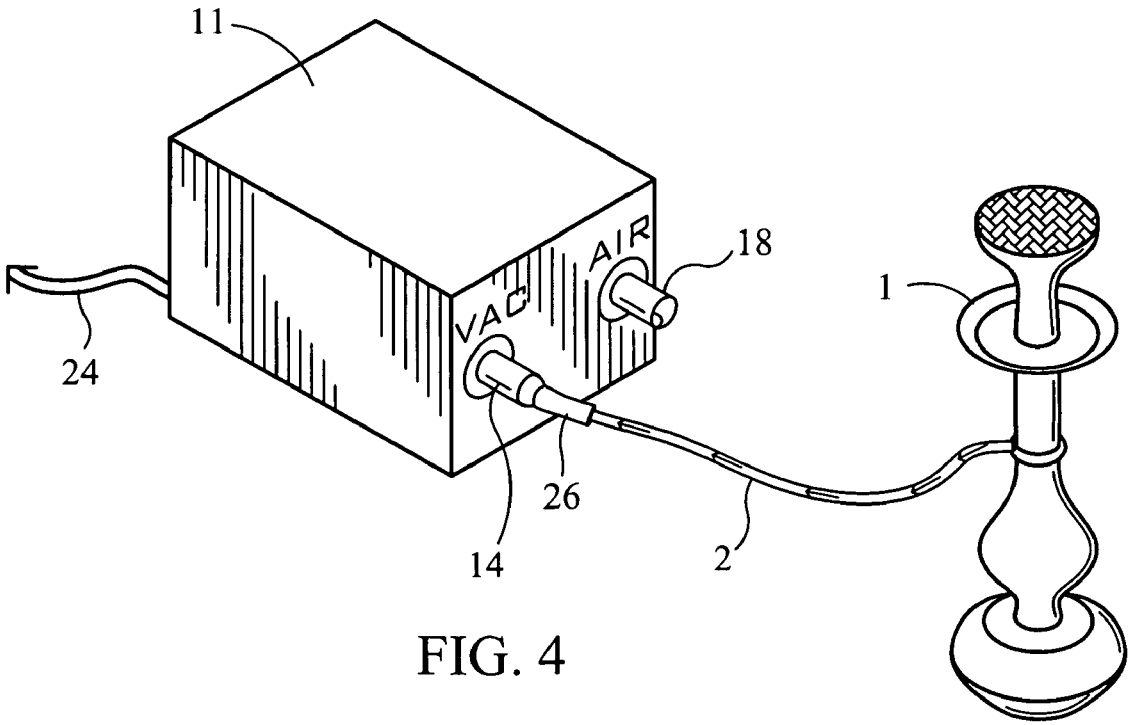
FIG. 4 is a perspective view of the preferred embodiment of the hookah accessory and a hookah connected to the vacuum port of the hookah accessory in accordance with the instant invention.
Figure 5:
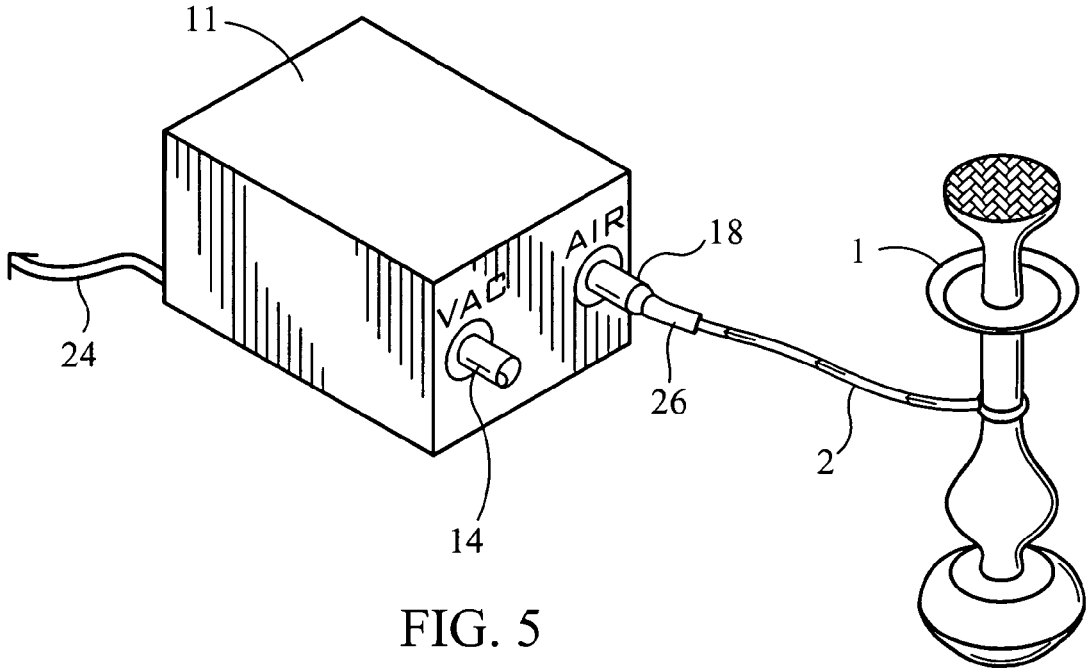
FIG. 5 is a perspective view of the preferred embodiment of the hookah accessory and a hookah connected to the blower port of the hookah accessory in accordance with the instant invention.

With reference to the drawings, FIGS. 1 to 12 depict the preferred embodiments of the instant invention which is generally referenced as a hookah accessory and, or by numeric character 10. The hookah accessory 10 is used for igniting and starting water pipes, such as hookahs 1, by providing a vacuum driven auxiliary suction force, and for cleaning water pipe hoses and water pipes with pressurized air generated by the vacuum return. The hookah accessory 10 provides an option to manually igniting and starting a hookah.

With reference to FIGS. 1-12, the preferred embodiment of the hookah accessory 10 of the instant invention comprises a vacuum 12; motor 13 electrically communicated with the vacuum 12 or integrally built into the vacuum 12 for driving the vacuum 12 as is known in the art; housing 11 for storing, facilitating operation of and securing the components of the instant invention 10; vacuum port 14 extending from the housing 11 and in fluid/pneumatic communication with the vacuum 12 so as to direct and provide access to the suction force generated by the vacuum and for receiving and securing a hose 2 used to start the hookah 1; filter 16 between the vacuum port 14 and vacuum 12 to capture debris before it reaches the vacuum 12 or vacuum motor 13; air pressure port 18 in fluid/pneumatic communication with the output/return port of the vacuum 12 for tapping, directing and providing access to pressurized air from the vacuum 12, which is used to clean a hose 2 and, or the hookah 1; vacuum port switch 34 at least partially disposed in the vacuum port 14 such that it is actuated when inserting or removing a hose or hose tip to automatically and respectively provide and remove power supplied to the vacuum-motor 13; and air pressure switch 38 at least partially disposed in the air pressure port 18 such that it is actuated when inserting or removing a hose or hose tip to automatically and respectively provide and remove power supplied to the vacuum-motor 13. The filter 16 is in line with the vacuum port 14 and vacuum 12 to capture debris before it reaches the vacuum 12 or vacuum motor 13. The vacuum and blower ports 14, 18 preferably comprise pliable and durable rubber ends that universally adapt to the dimensions of different size hoses or hose tips to substantially provide an air tight seal between the hose/hose-tip and port 14/18.

With reference to FIGS. 3, 4, 9 and 10, the hookah accessory 10 preferably includes a vacuum switch 34 in or near the vacuum port 14, air pressure switch 38 in or near the air pressure port 18, first/vacuum resistor 35 in series with the vacuum switch 34 and vacuum motor 13 and second/air resistor 39 in series with the air pressure switch 38 and vacuum motor 13. The switches 34, 38 are respectively triggered when inserting a hose or hose tip 26 in the corresponding vacuum port 14 or air pressure port 18, which applies power to the vacuum motor 13. When the hoses are respectively removed, the corresponding switches 34, 38 are actuated in a manner that removes power. When applying power, the vacuum 12 and, or vacuum motor 13 is preferably turned on at a preset power level based on which switch is actuated, i.e. vacuum switch 34 or air switch 38. The vacuum resistor 35 and air pressure resistor 39 provide a means for adjusting the power of the suction and air pressure forces generated by the vacuum 12 depending on which switch 34, 38 is triggered. The first/vacuum resistor 35 has a predetermined Ohm level, which fixes the amount of current to the vacuum motor 13 and hence the motor speed and suction force. The second/air resistor 38 has a predetermined Ohm level, which fixes the amount of current to the vacuum motor 13 and hence the motor speed and air pressure force tapped from the vacuum return port 18. When a hose is inserted in the vacuum port 14, the vacuum switch 34 is actuated connecting the power source 28 or 29 and vacuum resistor 35 in series with the vacuum motor 13. When a hose is inserted in the air pressure port 18, the air pressure switch 38 is actuated connecting the power source 28 or 29 and air pressure resistor 39 in series with the vacuum motor 13 The switches 34, 38 may be momentary push switches, toggle switches or similar switches known in the art.

Figure 6:
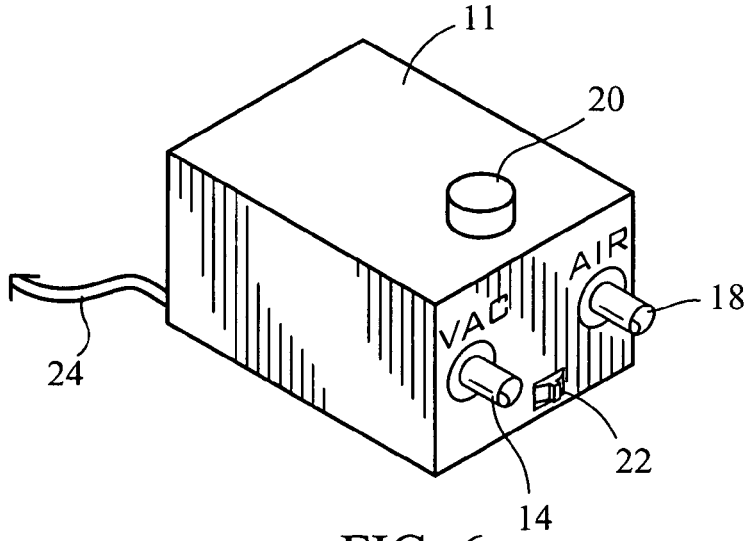
FIG. 6 is a perspective view of an alternative embodiment of the hookah accessory showing a motor speed adjustment knob and central switch in accordance with the instant invention.
Figure 11:
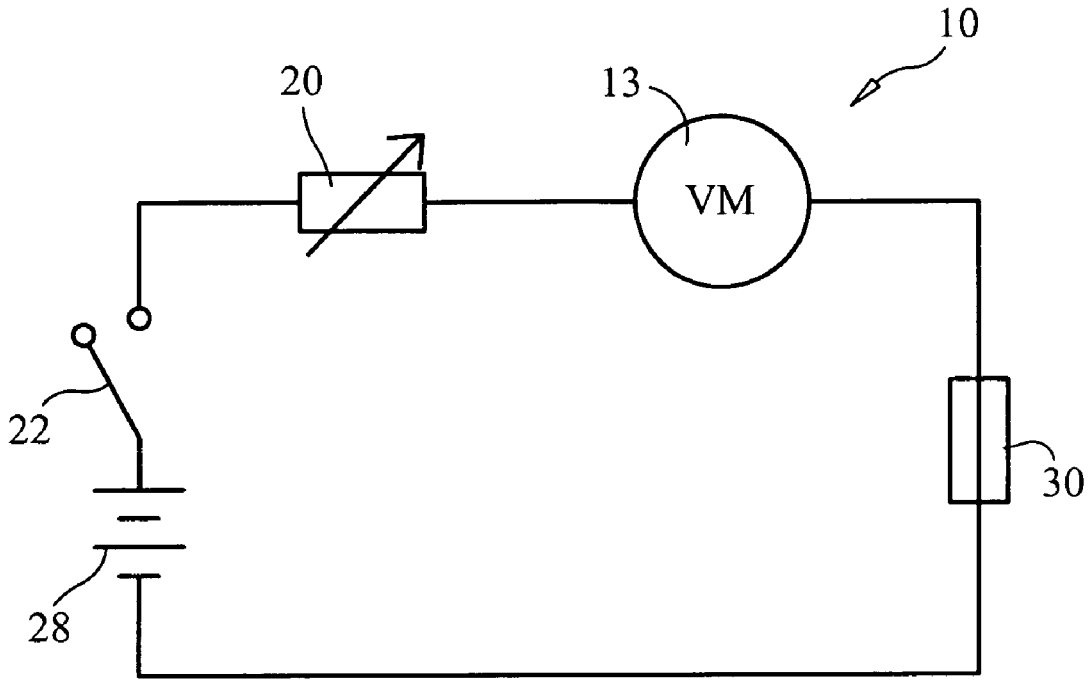
FIG. 11 is an electrical circuit diagram of the alternative embodiment of the hookah accessory using DC power and having a central switch in accordance with the instant invention.
Figure 12:
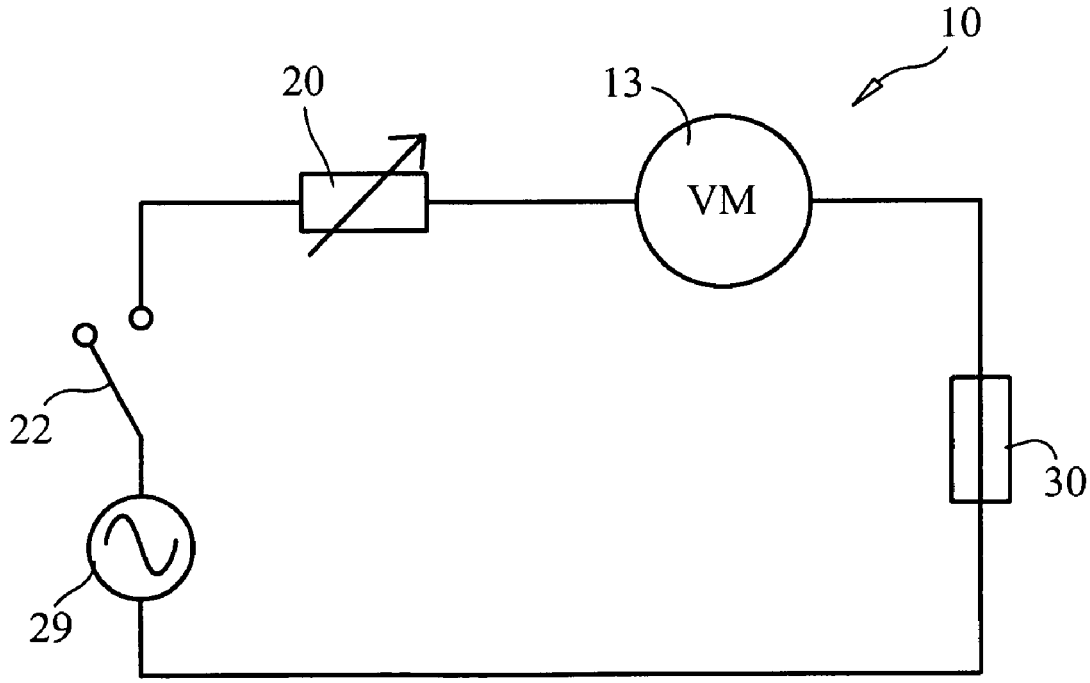
FIG. 12 is an electrical circuit diagram of the alternative embodiment of the hookah accessory using AC power and having a central switch in accordance with the instant invention.

With reference to FIGS. 6, 11 and 12, the alternative embodiment of the hookah accessory 10 comprises a central switch 22 that applies and removes power and a rheostat 20 for adjustably controlling the current to the vacuum motor 13 and hence the motor speed and suction and air pressure forces. The rheostat 20 allows for incremental adjustment of the motor speed.

Figure 7:
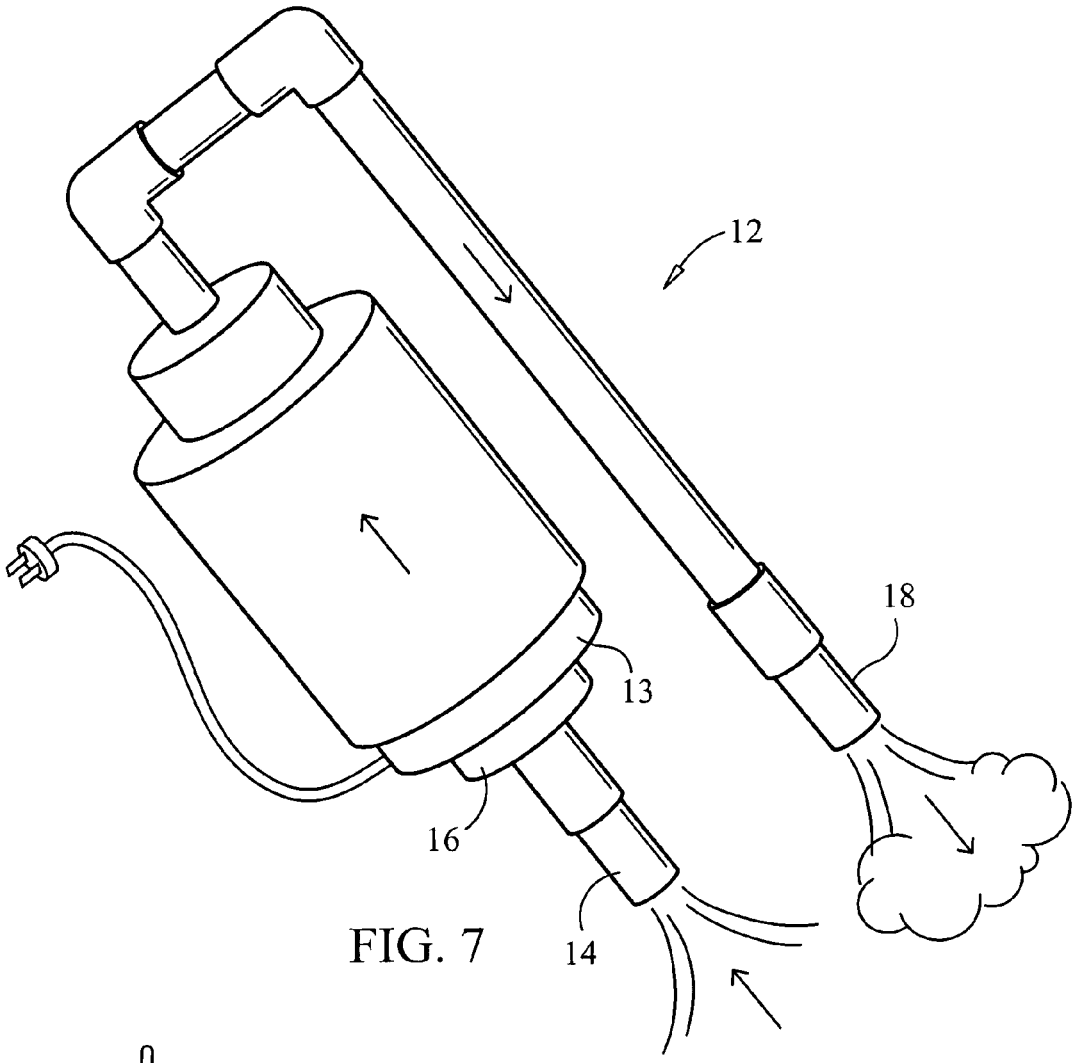
FIG. 7 is a perspective view of a motor driven vacuum of the preferred embodiment of the hookah accessory in accordance with the instant invention.
Figure 8:
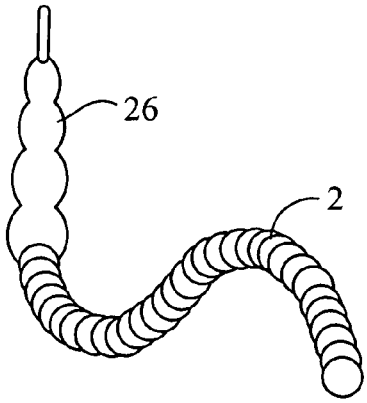
FIG. 8 is a perspective view of a hose and, or hose tip of the preferred embodiment of the hookah accessory in accordance with the instant invention.
Figure 9:
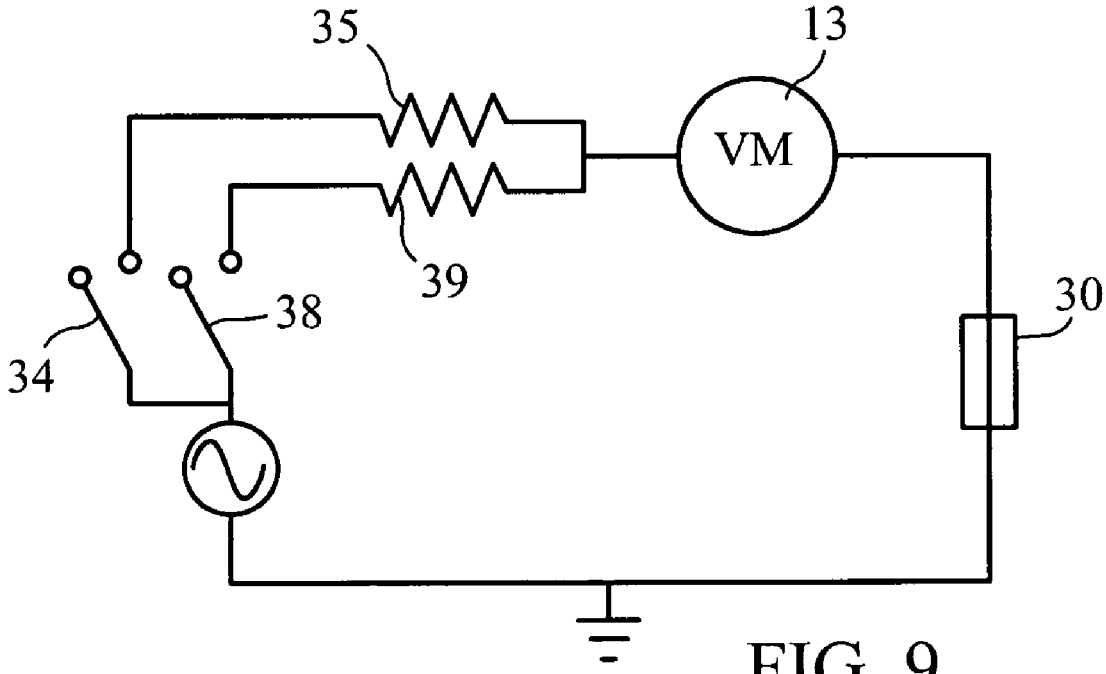
FIG. 9 is an electrical circuit diagram of the preferred embodiment of the hookah accessory using AC power and having automatic switches in accordance with the instant invention.
Figure 10:
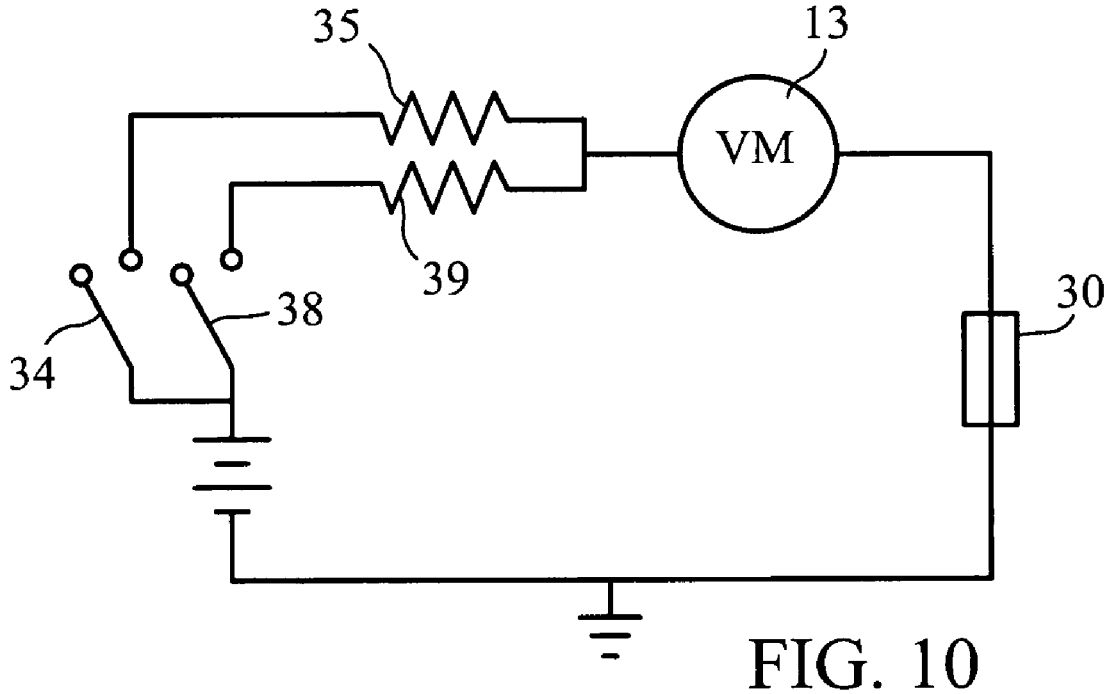
FIG. 10 is an electrical circuit diagram of the preferred embodiment of the hookah accessory using DC power and having automatic switches in accordance with the instant invention.

The instant invention 10 may also include hoses adapted for use with a plurality of hookahs 1 and the hookah accessory 10. With reference to FIG. 7, the preferred hose 2 has a tapered end or tip 26 having gripping ridges for creating an airtight or substantially airtight seal when inserted in a port 14, 18. To start the hookah 1, the hose 2 or hose tip 3 is inserted in the vacuum port 14, which connects the power source to the vacuum 12 and, or vacuum motor 13 in the preferred embodiment. In the alternative embodiment, the power switch 22 must be actuated before or after inserting the hose 2 or hose tip 3 in the vacuum port 14. In the preferred embodiment, the vacuum motor 13 speed is constant and preset to a desired suction level based on the value of the vacuum resistor 35. In the preferred embodiment, to use the hookah accessory 10 for cleaning a hose 2 or hookah 2 the hose 2 is inserted in the air pressure port 18, which connects the power source to the vacuum 12 and, or vacuum motor 13, providing an instant source of air. In the alternative embodiment, the power switch 22 must be actuated before or after inserting the hose 2 or hose tip 3 in the air pressure port 18. In the preferred embodiment, the vacuum motor 13 speed is constant and preset to a desired air pressure level based on the value of the air pressure resistor 39. In the alternative embodiment, the rheostat 22 is used to adjust the motor 13 speed and hence the suction and air pressure forces.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A water pipe accessory device for igniting tobacco loaded into the hookah and cleaning one or more hoses used with the hookah, said device comprising:

a housing enclosure;

a motor-driven vacuum, at least partially stored in and secured to said housing enclosure, for providing power that facilitates the creation of a suction force and blowing force by said vacuum;

a vacuum port accessible on said housing and in fluid/pneumatic communication with said vacuum for inserting a hose to tap and direct the suction force generated by said vacuum;

an air output port accessible on said housing and in fluid/pneumatic communication with a return line of said vacuum for inserting a hose to tap and direct the air blowing force generated by said vacuum;

means for adjusting the power of the suction and air pressure forces generated by said vacuum; and means for providing and removing electrical power to said motor-driven vacuum, wherein said means for providing and removing power comprises an a first automatic switch that is triggered to an on position when a hose is inserted in said vacuum port or said air pressure port and to an off position when the hose is removed from said vacuum port or said air pressure port.

2. A device as recited in claim 1, further comprising a motor electrically and mechanically communicated with said motor-driven vacuum.

3. A device as recited in claim 1, wherein said means for providing and removing power provides DC power.

4. A device as recited in claim 1, wherein said means for providing and removing power provides AC power.

5. A device as recited in claim 1, further comprising an electrical fuse.

6. A device as recited in claim 1, further comprising at least one hose adapted for insertion into at least one said port in a manner that at least substantially creates an airtight seal.

7. A device as recited in claim 1, wherein said first automatic switch is at least partially disposed in said vacuum port that is triggered to an on position when a hose is inserted in said vacuum port and to an off position when removed; and further comprising a second automatic switch is at least partially disposed in said air pressure port that is triggered to an on position when a hose is inserted in said air pressure port and to an off position when removed.

8. A device as recited in claim 7, wherein said means for adjusting the power of the suction and air pressure forces comprises:

a first electrical resistor in electrical communication with said motor and said first automatic switch to provide a first motor speed for a set suction force; and a second electrical resistor in electrical communication with said motor and said second automatic switch to provide a second motor speed for a set air pressure force, said first and second electrical resistors having different values.

9. A device as recited in claim 2, wherein said means for adjusting the power of the suction and air pressure forces comprises:

a first electrical resistor in electrical communication with said motor and said first switch to provide a first motor speed; and a second electrical resistor and second switch in electrical communication with said motor to provide a second motor speed, said first and second electrical resistors having different values so said first motor speed and second motor speed are different for setting the suction and air pressure forces.

* * * * *